United States Patent [19]

Birkmair

[11] Patent Number: 5,016,863

[45] Date of Patent: May 21, 1991

[54] ADJUSTABLE LONGITUDINAL FOLDING FORMER SYSTEM

[75] Inventor: Hubert Birkmair, Friedberg, Fed. Rep. of Germany

[73] Assignee: MAN Roland Druckmaschinen AG, Offenbach am Main, Fed. Rep. of Germany

[21] Appl. No.: 507,370

[22] Filed: Apr. 9, 1990

[30] Foreign Application Priority Data

Apr. 21, 1989 [DE] Fed. Rep. of Germany ..... 3913112

[51] Int. Cl.[5] ..... B41L 43/04

[52] U.S. Cl. ..... 270/41; 270/5

[58] Field of Search ..... 270/5, 40, 41; 493/405, 493/461, 446

[56] References Cited

U.S. PATENT DOCUMENTS 1,305,129 5/1919 Lange .
2,107,462 2/1938 Wood .
3,834,689 9/1974 Lee ..... 270/41

FOREIGN PATENT DOCUMENTS 252379 5/1912 Fed. Rep. of Germany .

OTHER PUBLICATIONS

A. Braun: "Atlas des Zeitungs-und Illustrationsdruckes" (Atlas of Newspaper and Magazine Printing), Frankfurt am Main, 1960, p. 66.

*Primary Examiner*—John T. Kwon
*Assistant Examiner*—Therese M. Newholm
*Attorney, Agent, or Firm*—Frishauf, Holtz, Goodman & Woodward

[57] ABSTRACT

To avoid the necessity to readjust rollers (3; 6) located in advance of and downstream of a moving web (1) passing over a folding former (4; 4*a*, 4*b*) upon adjusting the folding former, the former is retained on a holding structure (11, 12, 14, 15) which is pivotable about a pivot point (S) located at the side of the former which is at the side of the web passing over the former, and opposite the side of the web facing the former, so that the pivot point is located at the side of the former which faces the web. Upon pivoting the former, the tip (5) will move only over a slightly distance vertically with respect to the axes of rotation of pull-off rollers (6), and the back edge (5) will change only slightly with respect to tangential position related to the web supply roller (3). The folding former may be constructed as a split former (4*a*, 4*b*) in which the split parts are individually adjustable to change the angle ($\alpha$) of the folder parts.

9 Claims, 1 Drawing Sheet

ADJUSTABLE LONGITUDINAL FOLDING FORMER SYSTEM

FIELD OF THE INVENTION

The present invention relates to a longitudinal folding former system, in which the folding former is adjustable with respect to a supply roller and to pull-off rollers, to provide a longitudinal fold in a traveling web of a substrate, typically paper, received for example from a rotary printing machine.

BACKGROUND

Longitudinal folding formers are well known, see the literature reference A. Braun: "Atlas des Zeitungs- und Illustrationsdruckes" ("Atlas of Newspaper and Magazine Printing"), Frankfurt am Main, 1960, page 66, in which the folding former can be pivotably adjusted over a predetermined angular range. Proper operation of the folding former requires that the upper end thereof is placed as closely as possible tangentially to the periphery of a driven supply roller as shown, for example, in FIG. 81-II of the literature reference, and that the tip or apex of the folding former triangle is, at all times, as close as possible above the axial level of a pair of transversely positioned, mutually parallel pull-off rollers, as illustrated in FIG. 81-III of the literature reference.

Certain production arrangements of printed material on webs require a shift of the tip of the folding former horizontally. This shift can be obtained by pivoting the folding former. In a pivoting arrangement in accordance with the prior art, substantial vertical shift of the tip or nose or apex of the folding former triangle will result, coupled with a horizontal shift of the upper or inlet portion of the folding former. To provide proper alignment with the associated former rollers, namely the supply roller and the pull-off rollers, it previously was customary to reposition the axes of rotation of the supply roller and/or the pull-off roller pair, to provide for the required correction. Repositioning of roller axes is complex and expensive.

THE INVENTION

It is an object to provide an adjustable longitudinal folding former arrangement which does not have the disadvantages of the prior art, namely requiring repositioning of rollers upon changing of the position of the folding former.

Briefly, the pivot axis for pivotably adjusting the folding former is placed at the side of the web passing over the former which is opposite the side facing the former or, in other words, locating the pivot axis at the side of the former which faces the web.

In all adjustment arrangements of the prior art, the pivoting point for the folding former is on the underside thereof, that is, on the side of the folding former which is remote from the web passing thereover. Repositioning the pivot point to the other side, that is, to the top side or front side, has the unusual and unexpected advantage of substantially decreasing the shift of the apex of the folding former with respect to the pull-off rollers as well as the shift of the input line to the folding former, so that, upon pivoting the folding former, repositioning of the respective rollers is no longer necessary and, hence, all repositioning arrangements can be eliminated.

DRAWINGS

DETAILED DESCRIPTION

Figure 1:
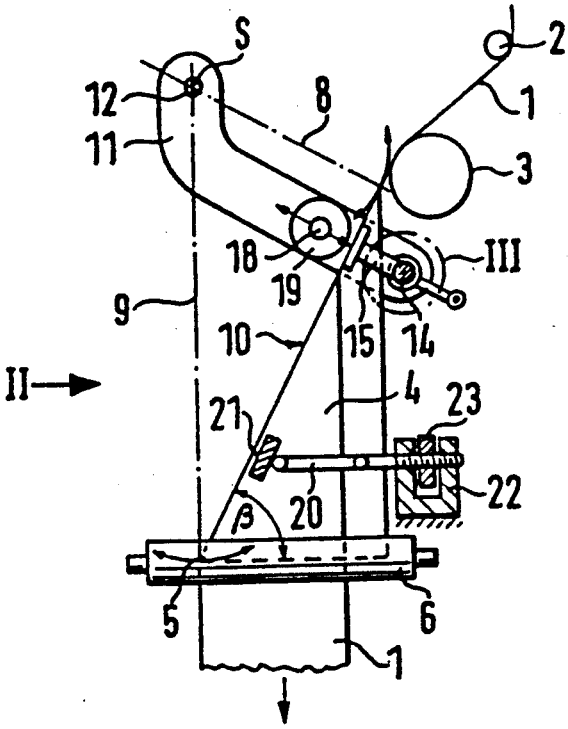
FIG. 1 is a side view of a folding former and a pivoting lever therefor, illustrating the position of the pivot point.

A traveling web 1 (FIG. 1) is guided to a folding former by a guide roller 2, and then passed over a driven folding supply roller 3, to be directed to the former 4. Former 4 can be a unitary forming triangle or funnel, or can be constructed in parts. The folding former 4 has a back end 25 and a tip or apex or former nose 5. The web 1 is passed over the pointed lower end of the former 4 and the tip 5, thereby providing a longitudinal fold, and two parallel web parts will result which are pulled off the former by a pair of pull-off rollers 6. The pull-off rollers 6 compress the fold and thereby stabilize it in its form and shape.

The folding former 4 is rotatable or pivotable with respect to the side walls 7 of the machine.

In accordance with a feature of the invention, the pivot point S, about which the folding former is pivotable, is located on the side thereof which faces the side of the web 1 remote from the web side which engages the folding former.

In accordance with a preferred feature of the invention, the pivot point S for the folding former is located at, or close to an intersection point or line of two straight lines 8 and 9. The first line or plane 8 extends in a plane 10 passing centrally through the upper end 25 of the folding former and perpendicular to the angle of inclination of the folding former $\beta$ (FIG. 1). The second straight line or plane 9 extends vertically, with reference, for example, to a horizontal plane parallel to the base of the printing machine, or, in other words, in the direction of the side walls 7 or, still in another definition, perpendicular to a connecting line between the axes of rotation of the pull-off rollers 6.

Most desirably, the pivot point S is located exactly at the intersection of the lines 8, 9. FIG. 1 illustrates, by curved arrows, the movement of the tip 5 and of the edge 25 upon pivotable adjustment about the pivot axis S. These curved arrows are located at the intersection of the lines 8, 9 with the respective tip and edge 5, 25 of the former.

The particular placement of the pivot point S for the former 4 has these specific advantages:

A comparatively long horizontal positioning path is available at the tip or nose 5 of the former over a path approximately parallel to the axes of rotation of the pull-off rollers 6. The height or level of the tip 5 with respect to the rollers hardly changes. The distance between the tip 5 and the rollers 6, upon adjustment, is so small that it can be neglected when the folder is pivoted out of the position shown in FIG. 1. Thus, vertical readjustment of the pull-off rollers 6 becomes unnecessary.

The upper end portion 25 of the folding former 4 moves in a path roughly parallel to the edge 10 thereof. The edge 10 of the folding former remains essentially tangential to the periphery of the supply roller 3, so that readjustment of the position of the supply roller 3 upon change of pivoting readjustment of the folding former becomes unnecessary.

The structural positioning of the folding former to pivot about the pivot point S, located as described, is easily obtained by providing two pivot levers 11, located closely adjacent to the inner side walls of the machine 7, in parallel thereto and movable with respect thereto. The pivot levers 11 are pivoted in the side wall 7 by bolts 12, located at one end thereof, in which a bolt 12 is pressed into or through a bore 13 in the machine side wall, to form a bearing bore for the respective bolt 12. The other ends of the pivot levers which, in lateral projection, are behind the folding former, are coupled at the inside or facing sides thereof to a connecting rod 14. At least one holder 15 is connected to the rear side of the folding former 4, which surrounds the rod 14 and which provides for support of the folding former on the rod 14.

Figure 2:
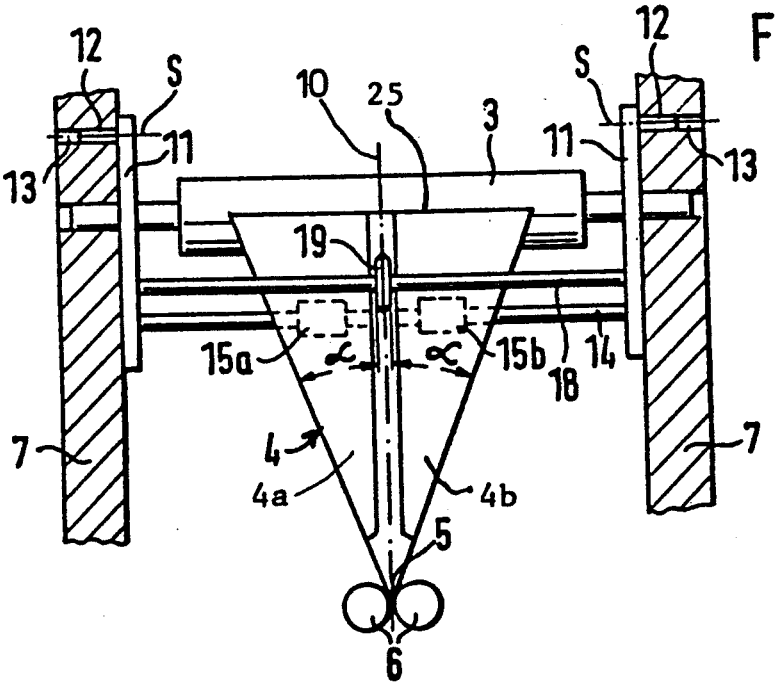
FIG. 2 is a front view of the folding former, with the side walls of the machine shown in fragmentary, sectional form.

The present invention is also applicable to a split former, and in accordance with a preferred feature of the invention, the folding former 4 is subdivided into two halves 4a, 4b centrally thereof, as seen in FIG. 2. Each one of the halves 4a, 4b has its own holder 15a, 15b at the back side thereof, each holder 15a, 15b being threaded on the rod 14. The holders 15a, 15b have oppositely inclined elongated openings or recesses 16 formed therein. A bolt 17 is located on and secured to the rod 14 at the level of the openings 16, extending into the respective opening 16.

Alternatively, holders 15a, 15b can be supplied with oppositely pitched inner threads, and the rod 14 formed with suitable outer threads of, likewise, opposite pitch.

Figure 3:
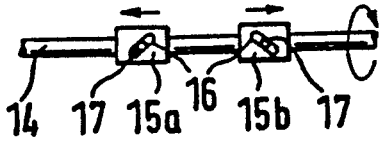
FIG. 3 is a detail view of a preferred adjustment arrangement for a split former.

Upon rotation of the rod 14—as seen in FIG. 3—the holders 15a, 15b are spread apart; upon opposite rotation, the holders are moved towards each other. This arrangement readily permits adjustment of the inclination of the two halves 4a, 4b of the former. Such a change of the former flank angle $\alpha$ is not necessary when the folding former 4 is pivoted only slightly; larger adjustments, however, in which the change of the angle $\beta$ (FIG. 1), which is the inclusion angle of the longitudinal or ridge edge 10 with the horizontal, requires matching of the angles $\alpha$ of the former. As seen in FIG. 2, this angle $\alpha$ is defined in frontal projection between line 10, passing through the tip 5 and centrally of the former, and the lateral edge of the former of either respective half.

The pivot levers 11 may, in accordance with a preferred feature of the invention, further form carrier elements of additional auxiliary apparatus. To support such apparatus, a further rod 18 is extended transversely on levers 11 across the former, slidable with respect to the ridge edge 10 of the former. Apparatus such as a cutter wheel, a grooving or ridging apparatus or a-perforating wheel 19 can be placed on the rod 18. When desired, the wheel 19 can be engaged against the web 1 on the former to cut, crease, or perforate the web as it passes over the former funnel or triangle.

Pivoting the former is readily obtained by a spindle rod 20 which, preferably, has an intermediate joint, coupled with one end to a holder 21 positioned at the back side of the former (FIG. 1) and, with the other end, which is threaded, to a nut 23, located in a bearing block 22. Rotating the nut 23 pivots the former.

The nut 23 can be externally geared, for engagement with a pinion of a positioning motor, so that pivoting of the former can be remotely controlled, for example from a central control console.

Various changes and modifications may be made within the scope of the inventive concept.

I claim:

1. Longitudinal folding system for folding a traveling web (1), particularly a printed web received from a rotary printing machine, having a frame (7);

a folding former (4, 4a, 4b) having triangular or funnel shape and defining ax apex (5), a center or ridge line (10) and a transversely extending base line (25);

a supply roller (3) guiding the web (1) towards the former (4);

a pair of pulling rollers (6) pulling the web from the former (4).

said former (4) being pivotably located with its apex (5) close to the nip between said pulling rollers (6) and its base line (25) close to the supply roller (3) and essentially parallel thereto; and pivotable support means (11–15) coupled to the former for pivotable movement with respect to the frame, and pivoting about a pivot point or axis (S), wherein, in accordance with the invention, said pivot point or axis (S) is located at the side of the web passing over the former (4) which is opposite the side of the web facing the former, whereby said pivot axis (S) will be located at that side of the former which faces the web, and wherein the pivot point or axis (S) of the former (4) is positioned approximately at eh intersection of two theoretical straight lines (8, 9), a first one (8) of said lines extending through the base line (25) at the center line (10) of the former and perpendicular to the angle of the inclination angle ($\beta$) of the former; and a second one (9) of said lines extending vertically from the apex (5) of the former.

2. The system of claim 1, wherein said pivot axis (S) is at the intersection of said two theoretical lines (8, 9).

3. The system of claim 1, further including holder means (15, 15a, 15b) located at the rear side of the folder remote from the side of the folder over which the web passes;

a cross rod (14) extending transversely of the folder, and supporting said holder means; and a pair of pivot levers (11) supporting, each, said cross rod (14) at one end of the respective levers, the other ends of said respective levers being pivotably coupled to the frame (7) for pivotably supporting the cross rod on the frame at said pivot axis (S).

4. The system of claim 1, wherein said former (4) is a split former including two former halves (4a, 4b) dividing the former along the center or ridge line (10);

and means (16, 17) to change the flank angle ($\alpha$) of the former coupled to the respective former halves (4a, 4b), said flank angle being defined by the front projection of the outer edge of a former half or portion (4a, 4b) and the center or ridge line (10) of the former.

5. The system of claim 4, further including holder means (15a, 15b) located at the back side of the former halves or portions (4a, 4b) and supporting the former halves or portions, said holder means being movable towards or away from each other; and a cross rod (14) retaining said holder means for supporting the former halves or portions and adjustably positioning said former halves or portions relative to each other.

6. The system of claim 5, wherein said holder means include holder blocks (15*a*, 15*b*), each formed with oppositely inclined elongated openings or recesses (16);

and engagement means (17) coupled to said cross rod (14) and engageable in said elongated inclined recesses or openings;

and wherein said cross rod is movable for shifting said engagement means in said inclined recesses or openings to thereby adjust the former halves or portions.

7. The system of claim 1, further including pivot levers (11) pivotably secured to the frame at said pivot axis (S);

means (14, 15) coupled to said pivot levers for pivotably supporting the former on said pivot levers;

and an accessory cross rod (18) secured to said pivot levers for supporting accessory elements (19) thereon.

8. The system of claim 7, wherein said cross rod is located at the side of the former (4) over which the web (1) passes, said cross rod coupling the pivot levers.

9. The system of claim 8, wherein said accessory comprises an engagement wheel (19) engageable with the web, for at least one of: cutting, creasing, or perforating said web.

* * * * *